US006367232B2

(12) United States Patent
Kim

(10) Patent No.: US 6,367,232 B2
(45) Date of Patent: Apr. 9, 2002

(54) TABLET CASSETTE INSTALLATION-ERROR PREVENTING SYSTEM FOR AUTOMATIC TABLET SUPPLYING AND PACKAGING APPARATUS

(75) Inventor: Jin S. Kim, Taegu (KR)

(73) Assignee: JV Medi Co., Ltd., Taegu (KR)

( * ) Notice: Subject to any disclaimer, the term of this patent is extended or adjusted under 35 U.S.C. 154(b) by 0 days.

(21) Appl. No.: 09/832,150

(22) Filed: Apr. 10, 2001

(30) Foreign Application Priority Data

Apr. 24, 2000 (KR) ..... 00-11568

(51) Int. Cl.[7] ..... B65B 57/00

(52) U.S. Cl. ..... 53/507; 53/155; 53/238; 221/197

(58) Field of Search ..... 53/507, 77, 155, 53/167, 168, 237, 238, 247, 52, 493; 70/382, 387, 432, 437; 221/197, 265; 206/528, 533; 222/562, 572

(56) References Cited

U.S. PATENT DOCUMENTS 3,348,392 A * 10/1967 Schreiber ..... 70/358
4,149,394 A * 4/1979 Sornes ..... 70/352
4,664,289 A * 5/1987 Shimizu et al. ..... 221/2
5,502,944 A * 4/1996 Kraft et al. ..... 53/55
5,660,305 A * 8/1997 Lasher et al. ..... 221/206
5,667,096 A * 9/1997 Wu ..... 221/6
5,671,592 A * 9/1997 Yuyama et al. ..... 53/493
5,852,911 A * 12/1998 Yuyama et al. ..... 53/168

FOREIGN PATENT DOCUMENTS

KR 202000011568 4/2000

* cited by examiner

*Primary Examiner*—Rinaldi I. Rada
*Assistant Examiner*—Thanh K. Truong
(74) *Attorney, Agent, or Firm*—John K. Park; Park & Sutton LLP

(57) ABSTRACT

A tablet cassette installation-error preventing system comprises cassette supports each having a front side, a rear side, a top side, and a rotor drive therein, wherein the rear side is fixedly attached on the outer periphery of a tablet dropping unit. Pin holes are formed in the top side of each cassette support and the cassettes are detachably mounted on the cassette supports. An installation-error detector having a base with an upper surface attached to the bottom of the cassette. Locking pins downwardly extend from the base lower surface so that the locking pins respectively fit in the pin holes when each tablet cassette is mounted on the cassette support.

12 Claims, 6 Drawing Sheets

TABLET CASSETTE INSTALLATION-ERROR PREVENTING SYSTEM FOR AUTOMATIC TABLET SUPPLYING AND PACKAGING APPARATUS

CLAIMING FOREIGN PRIORITY

The applicant claims and requests a foreign priority, through the Paris Convention for the Protection of Industry Property, based on a patent application filed in the Republic of Korea (South Korea) with the filing date of Apr. 24, 2000, with the application number 20-2000-0011568, by the applicant. (See the Attached Declaration)

BACKGROUND OF THE INVENTION

The invention relates to an automatic tablet supplying and packaging system. More particularly, the present invention relates to a tablet cassette installation-error preventing system for an automatic tablet supplying and packaging apparatus that detachably installs therein a plurality of tablet cassettes.

As is well known, an automatic tablet supplying and packaging apparatus realizes an pharmacy automation by enabling different types of prescription pills to be automatically packaged into a plurality of paper bags. To separately contain prescription tablets, the automatic system requires a plurality of tablets cassettes each containing a different type of tablets. The tablet cassettes are detachably mounted on the outer periphery of the system. In this construction, when a doctor's prescription information is input, the system allows required tablet cassettes to release tablets and the released tablets are packaged by packaging paper into tablet bags each of which can be taken by a patient one bag per dosage.

For the system operation, a pharmacist operating the tablet system needs to dismount tablet cassettes for refill when required. The refilled tablet cassettes are mounted back in the tablet system. When refilling the tablet cassettes, the concern of the operation pharmacist is to make sure each tablet cassette is installed where it was; otherwise the consequences could risk their patients. Although the racks receiving tablet cassettes in the system are numbered thereon and the tablet cassettes are also numbered thereon, because the tablet cassettes are same in size, there exists a possibility that a tablet cassette can be erroneously installed on a wrong rack which does not match in labeled number, which could lead to fatal results.

Accordingly, there has been a strong demand on the market for double-checking the tablet cassette installation and disabling a wrong installation of tablets cassettes.

SUMMARY OF THE INVENTION

Therefore, an object of the invention is to double-check a tablet cassette installation, thereby improving product reliability. Anther object of the invention is to prevent a tablet cassette installation error by disabling a wrong installation of tablet cassettes at the first stage by providing an error detector between tablet cassettes and cassette supports.

To achieve the above-described objects, a tablet cassette installation-error preventing system for an automatic tablet supplying and packaging apparatus including a tablet dropping unit and a tablet packaging unit below the tablet dropping unit, wherein a plurality of tablet cassettes are detachably mounted on an outer periphery of the tablet dropping unit to drop tablets therefrom to the tablet packaging unit, comprises: a plurality of cassette supports each having a front side, a rear side, a top side, and a rotor drive therein, wherein the rear side is fixedly attached on the outer periphery of the tablet dropping unit, wherein a plurality of pin holes are formed in the top side of said each cassette support, wherein the pin holes are respectively identical to each other in size and shape; the plurality of tablet cassettes detachably mounted on the plurality of cassette supports in correspondence thereto, wherein said each tablet cassette has a bottom side and a rotor therein operably engaged to the rotor drive; an installation-error detector having a base with an upper surface and a lower surface, wherein the upper surface of the detector base is attached to the bottom side of said each tablet cassette, wherein a plurality of locking pins corresponding to the plurality of pin holes downwardly extend from the lower surface of the detector base so that said locking pins can respectively fit in said pin holes of said each cassette support when said each tablet cassette is mounted on said cassette support.

In a preferred version, the tablet cassette installation-error preventing system further comprises one or more hole inserts to selectively block the pin holes, wherein the plurality of locking pins of said each tablet cassette are less in numeric quantity than the plurality of pin holes of said each cassette support so as to allow only one of said tablet cassettes to fit on said each cassette support.

Each hole insert has a hook protruded along a lower rim thereof and an elastic slot formed upwardly from a lower surface thereof, whereby said each insert is elastically inserted into a selected one of the pin holes. A flange is formed along an upper rim of said each hole insert, whereby said each hole insert is tightly maintained in the selected one of the pin holes. The pin holes are aligned in two or three rows such that each adjacent pair of the pin holes are equally distanced.

The advantages of the present invention are numerous. First, the installation-error detector enables a double checkup of the tablet cassettes installation by thoroughly preventing a possible installation error which may result in fatal consequences to patients. That is, the installation-error detector prevents a wrong placement of the tablet cassettes at the first stage, thereby improving product reliability.

Second, that the installation-error detector enables a pharmacist to feel safe installation of the tablet cassette while matching a tablet cassette to its corresponding cassette support, thereby exempting even a slight possibility of an erroneous installation of the tablet cassettes in addition to the double checkup through the labeling or numbering on the tablet cassettes and the cassette supports.

Third, the tablet cassette installation-error preventing system according to the present invention is easily applicable to a variety of automatic tablet supplying systems which need to completely satisfy strict regulations in each country due to its structural simplicity, for example, without regard to power supply.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
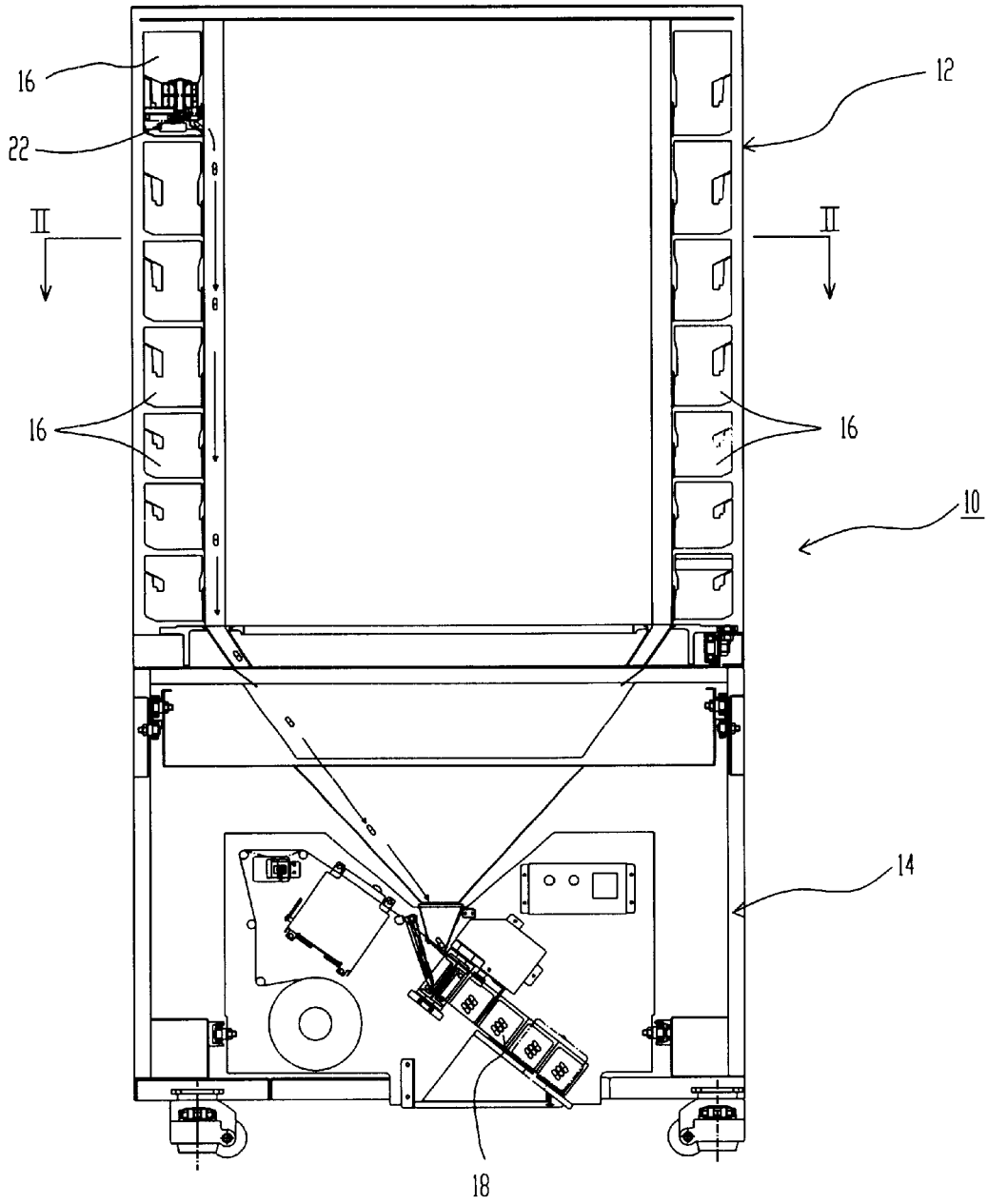
FIG. 1 is a cross-sectional view showing an automatic tablet supplying and packaging apparatus applicable to a tablet cassette installation-error preventing system according to the present invention.
Figure 2:
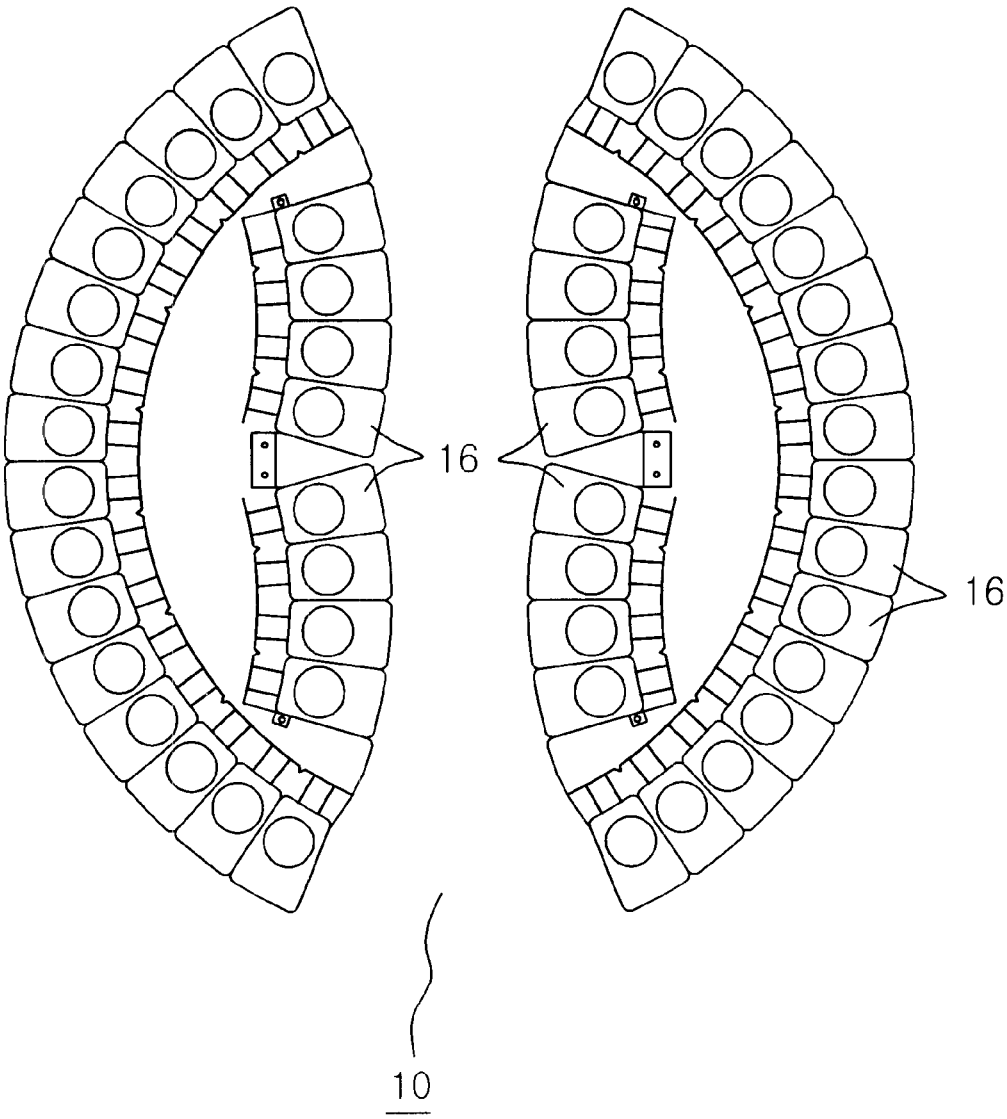
FIG. 2 is a schematic cross-sectional view taken along II—II in FIG. 1.

As shown in FIGS. 1 and 2, an automatic tablet supplying and packaging apparatus 10 includes a tablet dropping unit 12 and a tablet packaging unit 14. A plurality of tablet cassettes 16 are detachably stacked along an outer periphery of the tablet dropping unit 12. The tablet cassettes 16 selectively release tablets therefrom into the tablet packaging unit 14 which sequentially packages the dropped tablets into paper bags 18 in order for a patient to easily take a prescription dosage collected in each paper bag 18.

Figure 3:
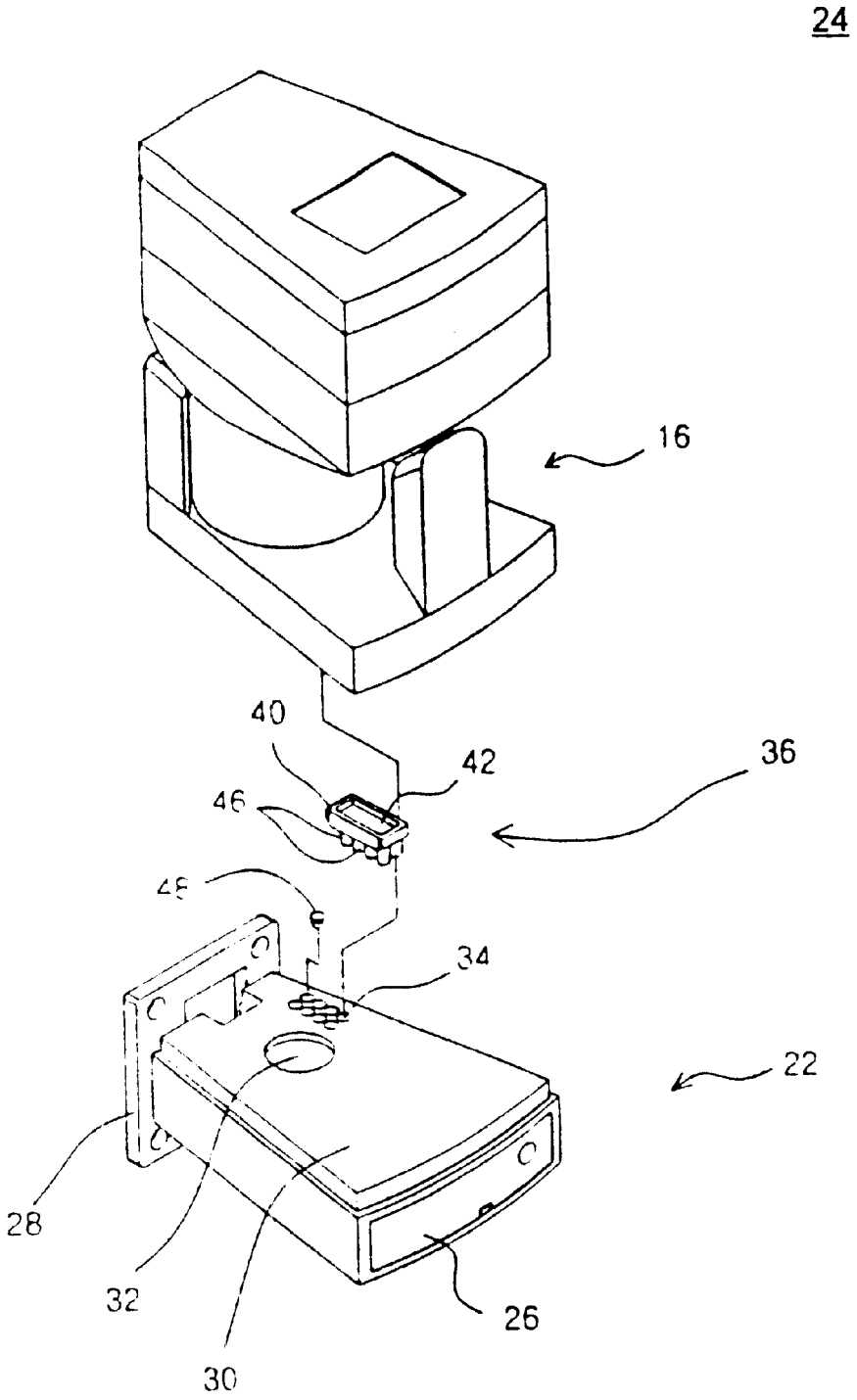
FIG. 3 is an exploded view showing a tablet cassette applicable to the system according to the present invention.

Referring to FIG. 3, each tablet cassette 16 is mounted on a cassette support 22 that is fixed to the outer periphery of the tablet dropping unit 12. In this construction, the tablet cassette 16 is detachably installed on the cassette support 22. Between the tablet cassette 16 and the cassette support 22 is provided an installation-error preventing system 24 according to the present invention.

Figure 4:
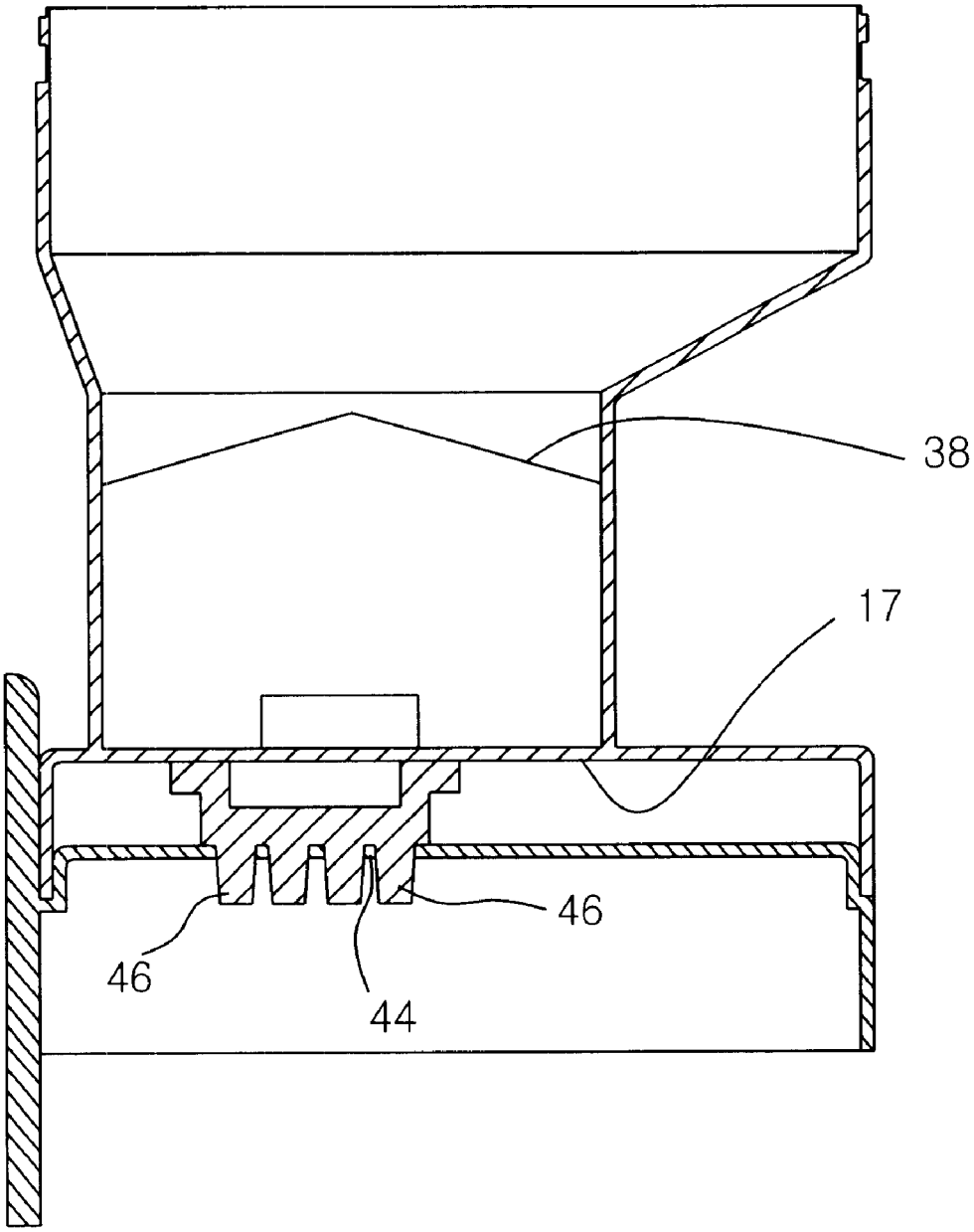
FIG. 4 is a cross-sectional view of the tablet cassette in FIG. 3.
Figure 5:
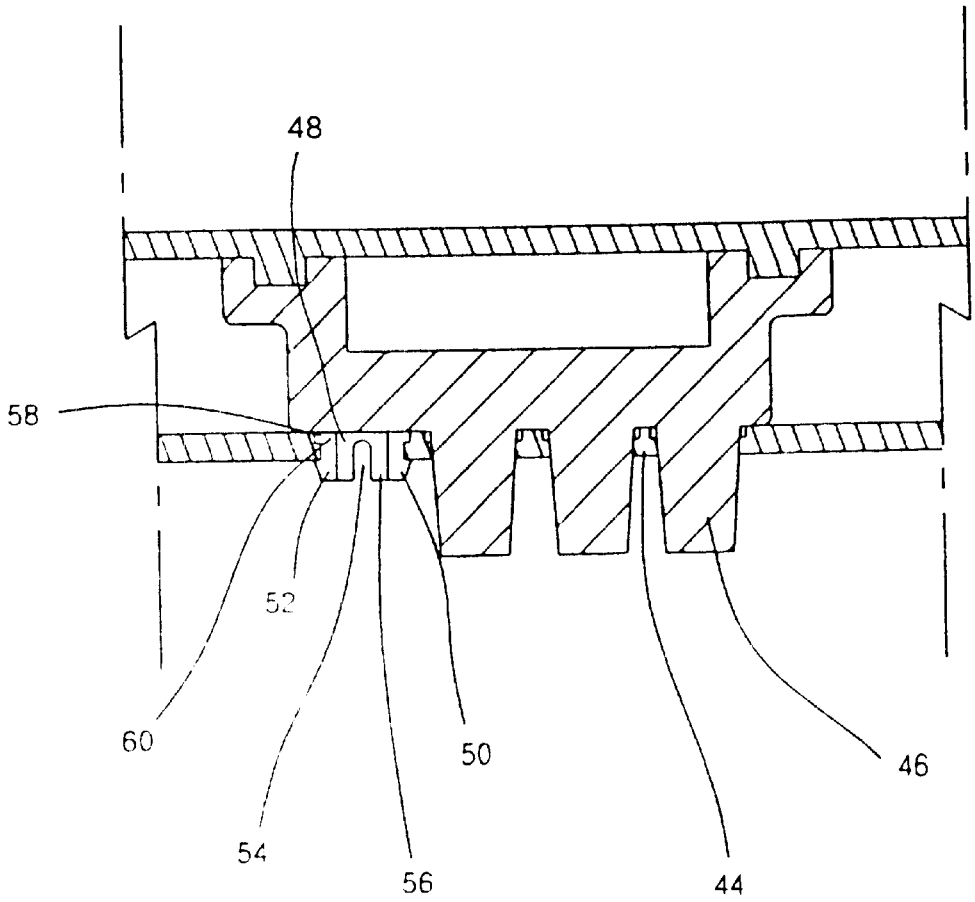
FIG. 5 is an enlargement view of the tablet cassette installation-error preventing system according to the present invention.

Further referring to FIGS. 4 and 5, the tablet cassette installation-error preventing system 24 according to the present invention comprises a plurality of cassette supports 22 each having a front side 26, a rear side 28, a top side 30, and a rotor drive 32 therein, wherein the rear side 28 is fixedly attached on the outer periphery of the tablet dropping unit 12. A plurality of pin holes 34 are formed in the top side 30 of each cassette support 22. For a better performance, the pin holes 34 are respectively formed identical to each other in size and shape. Preferably, each of the pin holes 34 is about 0.1 inch to 1.0 inch deep.

The installation-error preventing system 24 further comprises a plurality of tablet cassettes 16 and an installation-error detector 36. The plurality of tablet cassettes 16 are detachably mounted on the plurality of cassette supports 22 in correspondence thereto. Each tablet cassette 16 has a bottom side 17 and a rotor 38 therein that is operably engaged to the rotor drive 32. The rotor drive 32 can be a motor. The installation-error detector 36 has a base 40 with an upper surface 42 and a lower surface 44. The upper surface 42 of the detector base 40 is attached to the bottom side 17 of each tablet cassette 16.

Meanwhile, a plurality of locking pins 46 are formed to downwardly extend from the lower surface 44 of the detector base 40 corresponding to the plurality of pin holes 34 so that the locking pins 46 can respectively fit in the pin holes 34 of each cassette support 22 when each tablet cassette 16 is mounted on the cassette support 22.

Figure 6:
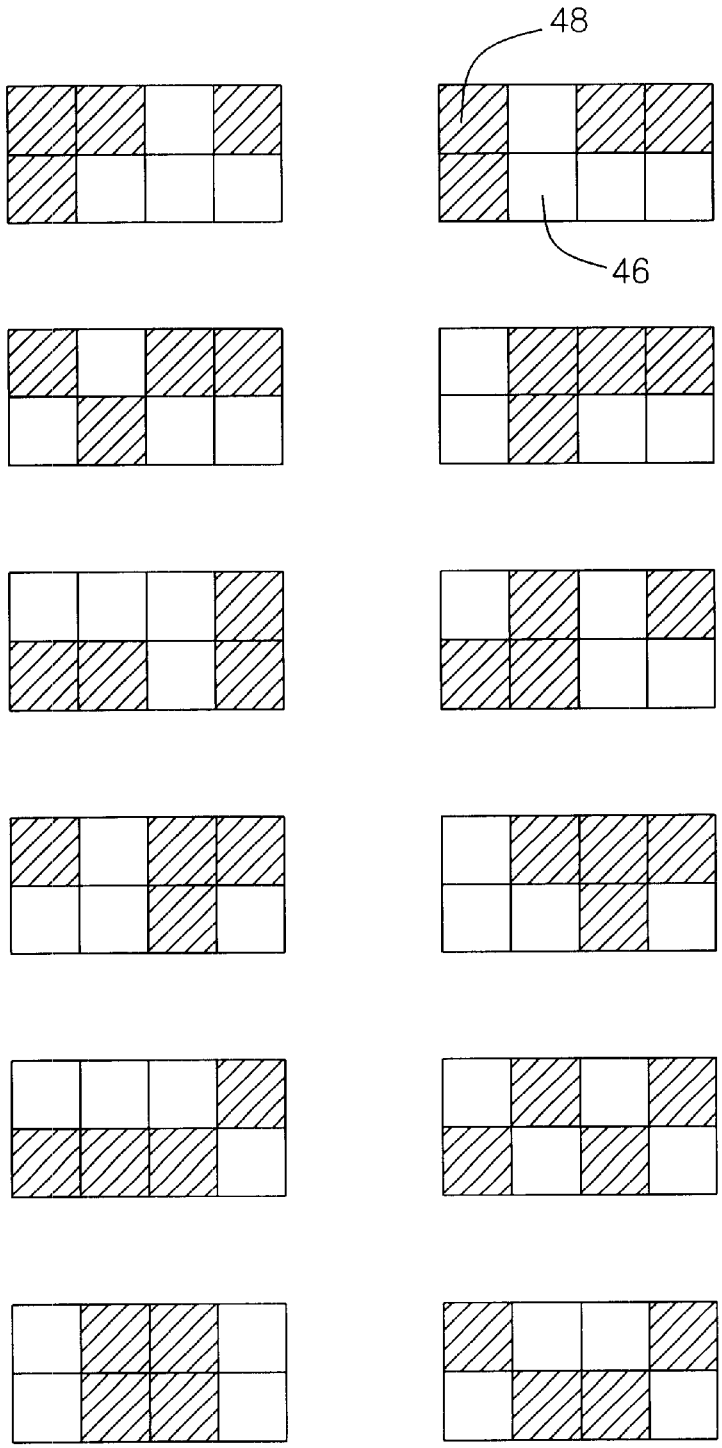
FIG. 6 is an exemplary view showing locking pin alignments.

In an embodiment, the tablet cassette installation-error preventing system 24 further comprises one or more hole inserts 48 to selectively block the pin holes 34, wherein the plurality of locking pins 46 of each installation-error detector 36 are less in numeric quantity than the plurality of pin holes 34 of each cassette support 22 so as to allow only one of the tablet cassettes 16 to fit on each cassette support 22. FIG. 6 shows an exemplary alignment of the inserts 48 in the pin holes 34. As shown therein, the alignment variations enables the installation of the tablet cassettes 16 on the cassette supports 22 without limitation by adjusting the number of pin holes 34, the locking pins 46 and the inserts 48.

As shown back in FIG. 5, each of the hole inserts 48 is inserted into a corresponding one of the pin holes 34 and has a hook 50 protruded along a lower rim 52 thereof and an elastic slot 54 formed upwardly from a lower surface 56 thereof. As a result, each of the hole inserts 48 is elastically inserted into a selected one of the pin holes 46. Also, a flange 58 is formed along an upper rim 60 of each hole insert 48 so that each hole insert 48 can be tightly maintained in the selected one of the pin holes 34. Here, the pin holes 34 may be aligned in two or three rows such that each adjacent pair of the pin holes 34 are equally distanced.

An advantage of the present invention is that the installation-error detector enables a double checkup of the tablet cassettes installation by thoroughly preventing a possible installation error which may result in fatal consequences to patients. That is, the installation-error detector prevents a wrong placement of the tablet cassettes at the first stage, thereby improving product reliability.

Another advantage is that the installation-error detector enables a pharmacist to feel safe installation of the tablet cassette while matching a tablet cassette to its corresponding cassette support, thereby exempting even a slight possibility of an erroneous installation of the tablet cassettes in addition to the double checkup through the labeling or numbering on the tablet cassettes and the cassette supports.

Further, the tablet cassette installation-error preventing system according to the present invention is easily applicable to a variety of automatic tablet supplying systems which need to completely satisfy strict regulations in each country due to its structural simplicity, for example, without regard to power supply.

Although the invention has been described in considerable detail, other versions are possible by converting the aforementioned construction. Therefore, the scope of the invention shall not be limited by the specification specified above and the appended claims.

What is claimed is:

1. A tablet cassette installation-error preventing system for an automatic tablet supplying and packaging apparatus including a tablet dropping unit and a tablet packaging unit below the tablet dropping unit, wherein a plurality of tablet cassettes are detachably mounted on an outer periphery of the tablet dropping unit to drop tablets therefrom to the tablet packaging unit, comprising:

a) a plurality of cassette supports each having a front side, a rear side, a top side, and a rotor drive therein, wherein the rear side is fixedly attached on the outer periphery of the tablet dropping unit, wherein a plurality of pin holes are formed in the top side of said each cassette support, wherein the pin holes are respectively identical to each other in size and shape;

b) the plurality of tablet cassettes detachably mounted on the plurality of cassette supports in correspondence thereto, wherein said each tablet cassette has a bottom side and a rotor therein operably engaged to the rotor drive;

c) an installation-error detector having a base with an upper surface and a lower surface, wherein the upper surface of the detector base is attached to the bottom side of said each tablet cassette, wherein a plurality of locking pins corresponding to the plurality of pin holes downwardly extend from the lower surface of the detector base so that said locking pins can respectively fit in said pin holes of said each cassette support when said each tablet cassette is mounted on said cassette support.

2. The system of claim 1 wherein the pin holes are aligned in two rows.

3. The system of claim 2 wherein each adjacent pair of the pin holes are equally distanced.

4. The system of claim 1 wherein the pin holes are aligned in three rows.

5. The system of claim 4 wherein each adjacent pair of the pin holes are equally distanced.

6. A tablet cassette installation-error preventing system for an automatic tablet supplying and packaging apparatus including a tablet dropping unit and a tablet packaging unit below the tablet dropping unit, wherein a plurality of tablet cassettes are detachably mounted on an outer periphery of the tablet dropping unit to drop tablets therefrom to the tablet packaging unit, comprising:

a) a plurality of cassette supports each having a front side, a rear side, a top side, and a rotor drive therein, wherein the rear side is fixedly attached on the outer periphery of the tablet dropping unit, wherein a plurality of pin holes are formed in the top side of said each cassette support, wherein the pin holes are respectively identical to each other in size and shape;

b) one or more hole inserts to selectively block the pin holes;

c) the plurality of tablet cassettes detachably mounted on the plurality of cassette supports in correspondence thereto, wherein said each tablet cassette has a bottom side and a rotor therein operably engaged to the rotor drive;

d) an installation-error detector having a base with an upper surface and a lower surface, wherein the upper surface of the detector base is attached to the bottom side of said each tablet cassette, wherein a plurality of locking pins downwardly extend from the lower surface of the detector base, wherein the plurality of locking pins of said each tablet cassette are less in numeric quantity than the plurality of pin holes of said each cassette support so as to allow only one of said tablet cassettes to fit on said each cassette support.

7. The system of claim 6 wherein said each hole insert has a hook protruded along a lower rim thereof and an elastic slot formed upwardly from a lower surface thereof, whereby said each insert is elastically inserted into a selected one of the pin holes.

8. The system of claim 7 wherein a flange is formed along an upper rim of said each hole insert, whereby said each hole insert is tightly maintained in the selected one of the pin holes.

9. The system of claim 6 wherein the pin holes are aligned in two rows.

10. The system of claim 9 wherein each adjacent pair of the pin holes are equally distanced.

11. The system of claim 6 wherein the pin holes are aligned in three rows.

12. The system of claim 11 wherein each adjacent pair of the pin holes are equally distanced.

* * * * *